United States Patent [19]

Edwards

[11] Patent Number: 4,712,791

[45] Date of Patent: Dec. 15, 1987

[54] EXERCISE MACHINE

[76] Inventor: Pansy S. Edwards, 16 Caraway Rd., Reisterstown, Md. 21136

[21] Appl. No.: 914,365

[22] Filed: Oct. 2, 1986

[51] Int. Cl.[4] ..... A63B 21/00

[52] U.S. Cl. ..... 272/73; 272/130; 272/132; 272/134; 272/141; 272/144

[58] Field of Search ..... 272/73, 70, 134, 130, 272/135, 144, DIG. 4, 136, 141, 142, 132; 128/25 R

[56] References Cited

U.S. PATENT DOCUMENTS

| | | | |
|---|---|---|---|
| 1,872,256 | 8/1932 | Denney | 272/73 |
| 2,283,475 | 5/1942 | Wagner | 272/134 X |
| 4,227,689 | 10/1980 | Keiser | 272/130 |
| 4,279,415 | 7/1981 | Katz | 272/70 |
| 4,285,515 | 8/1981 | Gezari | 272/DIG. 4 |
| 4,509,746 | 4/1985 | Mask | 272/144 X |
| 4,550,908 | 11/1985 | Dixon | 128/25 R X |
| 4,572,501 | 2/1986 | Durham et al. | 128/25 R X |

FOREIGN PATENT DOCUMENTS

| | | | |
|---|---|---|---|
| 2096006 | 10/1982 | United Kingdom | 128/25 R |

*Primary Examiner*—Dave W. Arola

*Attorney, Agent, or Firm*—Erwin S. Teltscher

[57] ABSTRACT

An exercise machine includes a base, an exercise device mounted on the base for exercising at least the limbs of a user, and a positionally adjustable user support device connected to the base for permitting a user to actuate the exercise device in a selected posture between upright and inclined positions.

8 Claims, 4 Drawing Figures

EXERCISE MACHINE

BACKGROUND OF THE INVENTION

With the advent of an increased consciousness for fitness, a number of fitness machines have appeared on the market permitting a plurality of excercise movements to be performed on a single machine. Examples of such are Universal Weight Machines and Nautilus Machines which permit muscle building exercises by employing a great many heavy weights. These machines, however, do not adequately exercise the cardiovascular system of the user.

Other exercise machines have appeared on the market recently which are designed to improve the cardiovascular fitness of the user. Such exercise is commonly known as aerobic exercise. When a strenuous aerobic activity such as jogging is undertaken conscientiously an a daily basis, a number of health benefits are derived. These strengthen the circulatory system including the heart, reduce cholesterol and high blood pressure and significantly reduce the occurrance of heart disease and stroke. Traditional aerobic exercise machines have been confined to a single exercise movement, such as the bicycle machine. These machines do not, however, provide any means for the simultaneous exercise of the upper and lower body as well as of the cardiovascular system. The instant invention combines all these desirable features in a single unit.

SUMMARY OF THE INVENTION

It is the objective of this invention to provide a complete fitness center confined to a single machine. This machine not only increases the muscle tone of the lower body, and of the upper body, but also of the cardiovascular system. Another important feature is that all these objectives are acomplished at the same time, thereby providing the user with substantially complete excercise fitness of his entire body in the time usually required to excercise just one portion of the body.

It is a further object of the instant invention to provide an exercise machine suited for both men and women, but particularly for women. It is a further object of the invention to stimulate all muscles of the body particularly facial, arm and neck muscles. It is still another object of the present invention to provide an exercising machine which can be set up easily in business offices.

A further objective of the instant invention is to provide a self-contained fitness center without the hazards associated with the conventional exercise of jogging. Jogging entails a number of physical risks. It is not uncommon for joggers to develop problems such as shin splints, knee problems, sprained ankles and even stress fractures.

The instant invention provides greater benefits than jogging, but eliminates the above mentioned risks. A position adjustment means allows the user to jog in a substantially horizontal position, if he desires. This will eliminate leg and foot injury caused by the foot repeatedly absorbing the jogger's weight and the foot's constant pounding to the ground. This allows even individuals already inflicted with the above mentioned leg and foot injuries to continue their fitness program without pain or any further injury. A jogging movement resisting means permits the full jogging motion to be met with a resistive force. The extra effort required to overcome the force that resists the user's to-and fro leg movemenmts creates benefits not found in jogging.

Various exercise movement devices allow the user to perform different movements to tone his or her upper body muscles. These movements allow attainment of substantially complete upper body fitness.

The unique combination of the above mentioned features allows the user to aerobically exercise his cardiovascular system and upper body while simultaneously exercise his lower body limbs without the risk of injury to his legs or feet.

BRIEF DESCRIPTION OF THE DRAWINGS

The invention will be better understood with reference to the drawings, in which.

DESCRIPTION OF THE PREFERRED EMBODIMENT

Figure 2:
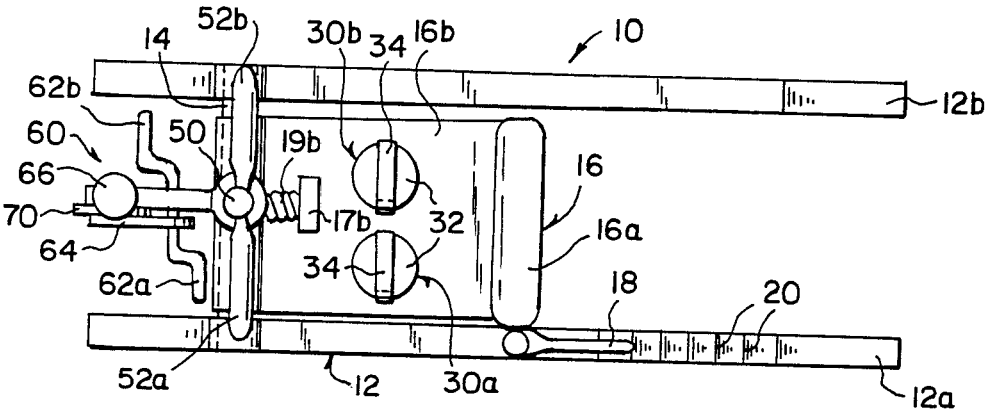
FIG. 2 is a top plan view of the exercise machine, according to the present invention.
Figure 1:
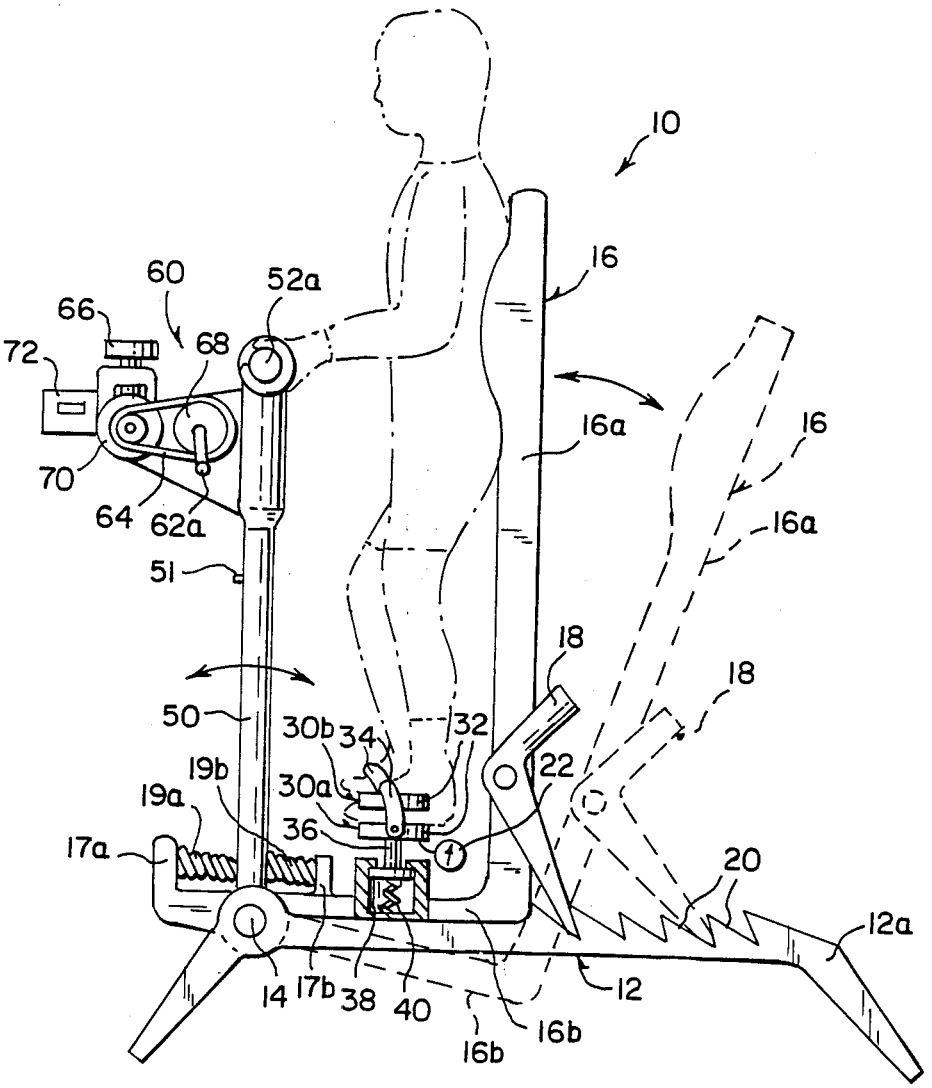
FIG. 1 is an elevation view of an exercise machine, according to present invention.

In a preferred embodiment, an exercise machine 10 is supported on a foundation 12. As shown in FIG. 1, the base 12 is of an open-ended trapezoid shape. It consists of two juxtaposed open-ended trapezoid structures **12*a* and 12*b* transversely connected to one another by at least one cross-member 14, as best shown in FIG. 2. Further shown in FIGS. 1 and 2 are ratchet teeth 20 formed on the structure 12*a*. The foundation base 12** is prefereably made of a strong inflexible material capable of supporting a heavy weight.

A user support means takes the form of an L-shaped bracket 16 connected to the cross-element 14, and pivotally movable there-around. As illustrated in FIG. 1, the user support means 16 can be pivoted around the cross-members 14 from an upright position to a position inclined with the horizontal. A pawl 18 is connected to the L-shaped bracket 16, so as to be fixedly secured thereto within a selected range of angular positions. As illustrated in FIG. 1, the pawl 18 is user operated, so as to adjust the L-shaped bracket 16 to a desired position. This is accomplished by inserting the lower portion of the pawl 18 into a selected ratchet tooth 20 located on the base 12, thereby adjusting the positional angle of the L-shaped bracket 16.

Figure 3:
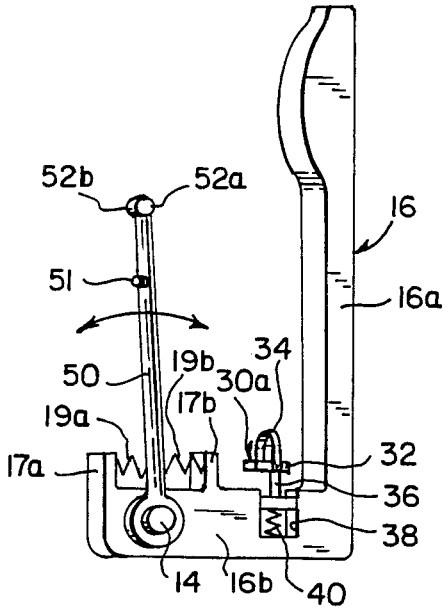
FIG. 3 is a fragmentary perspective view of the user support means, to which an arm support post of the exercise machine is connected, according to the present invention.

As illustrated in FIG. 3, the user support means 16 includes two parts. A first part **16*a* is essentially a backrest which fits the contours of the user's back. In an inclined position, the backrest 16*a* supports the user's weight, while he or she is exercising. The backrest 16*a*** is preferably made of a strong inflexible material covered with a leather-like cover, and provided with padding for maximum comfort of the user.

In its upright position, a foot support part **16*b* of the L-shaped bracket 16** supports the user, while he or she is exercising in an upright position.

Connected to the foot support part **16*b* are two foot pedals 30*a* and 30*b*, as shown in FIGS. 1–3. Each foot pedal includes a footrest 32 for the user to place each foot in, straps 34 to place each foot into the respective footrests 32, so as to insure each footrest 32** moves in compliance with the user's up and down foot movement, while the user runs in place.

As best shown in FIGS. 1 and 3, connected to the underside of each footrest 32 is a piston 36. As each footrest moves up and down, piston 36 is moved in and out of a cylindrical piston chamber 38. Inside the piston chamber 38 is a spring 40. Piston 38 is connected to the top of spring 40, while the bottom of spring 40 is fastened to the lower floor of the chamber 38. In a preferred embodiment, the spring 40 in its rest state fits into chamber 38 without exerting any force on the upper or lower chamber 38 walls. Nor is the spring 40 in its fully compressed state while at rest. When the user lifts his leg in a jogging movement, the spring 40 is stretched, thereby creating a downward resistive force on the user's leg. When the user's leg is moved in a downward direction, spring 40 is compressed, thereby exerting an upward resisting force on the user's leg. Thus spring 40 exerts a continuous resistive force opposing the piston 36's up and down movement caused by the user's running movements.

Consequently, while the user is running in place, his to-and-fro leg movements are met with the resistive force supplied by the springs 40. This additional force increases muscle tone, and provides the benefit of more "exercise" per unit of time than traditional jogging, because more effort is required. When the user is jogging in an inclined position, the inventive device further reduces any potential injury to the legs and feet caused by the legs' constant absorption of the jogger's weight and feet pounding the ground. This even allows runners whose legs may have been impaired to jog without further pain or risk of any additional injury.

A pedometer 22 records the number of steps taken by the "jogging-in-place" user. This feature is shown in FIG. 1.

Figure 4:
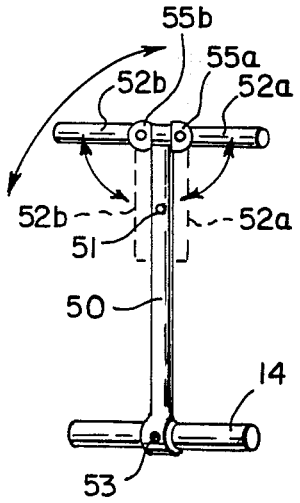
FIG. 4 is a perspective view of the arm support post of the exercise machine, and its two handles, according to the present invention.

As best seen in FIGS. 1 and 4, further connected to the cross-member 14 is an arm support post 50. Arm support post 50 is a telescopicably adjustable post, which can be set and maintained at a given height by a spring-operated pin 51 engageable in an opening of the outer telescopic tube of the arm support post 50. Arm support post 50 is attached to the foot support part **16*b* as illustrated in FIG. 4, so as to be able to pivot around crossmember 14, optionally in unison with the L-shaped bracket by means of a non-illustrated bracket connected therebetween. It can alternately be held in a fixed position by a screw 53. The arm support post 50 though is not locked into a user selectable position, as is the L-shaped bracket 16 via the pawl 18 and the ratchet teeth 20**.

Arm support post 50 is in contact with user foot support means **16*b* at its base, and is adjusted so that handles 52*a* and 52*b* rise to a level approximating the height of the user's elbows, as seen in FIG. 1. Handles 52*a* and 52*b* are for the user to grasp with his left and right hands, respectively. In a preferred embodiment, the user pushes the handles 52*a* and 52*b* away and toward his or her body in a first arm exercise rowing movement. This movement causes arm support post 50, when rigidly fixed to the base member 14 by the screw 53, to pivot along a vertical plane about base member 14**.

As shown in FIGS. 1 to 3, upwardly extending extension members **17*a* and 17*b* of the L-shaped bracket 16 are so situated on the foot support surface 16*b* as not to restrict the full extension and retraction of the user's arms to and from his or her body, while using the first arm exercise motion provided by the arm support post 50. Springs 19*a* and 19*b* provide a resistive force in opposition to the user's arm movements. For example, when the user pushes arm support post 50 away from his or her body, the spring 19*a* is compressed and spring 19*b* is stretched. When the user pulls the arm support post 50 toward his or her body, the spring 19*a* is then stretched, while spring 19*b* is compressed. In both situations, the springs 19*a* and 19*b*** exert an opposite resistive force to the user's arm movement. This further increases the muscle tone in the user's arms, hands, shoulders and chest.

As best seen in FIG. 4, locking means 53 is used to connect the arm support post 50 to the cross-member 14. Locking means 53 is advantageously a thumb screw. When the thumb screw 53 is not tightened to the cross-member 14, the arm support post 50 is free to pivot about the cross-member 14, thus permitting the above-described first arm exercise movement. However, when the user tighten thumb screw 53, the arm support post 50 becomes fastened to the cross-member 14 thereby preventing the arm support post 50 from pivoting. This enables the user to utilize other arm movement exercises described hereinbelow.

Handles **52*a* and 52*b* are connected to the arm support post 50 by means of two well known lockable hinges 55*a* and 55*b*, respectively, as shown in FIG. 4. When the user desires to employ the second arm exercise movement, the thumb screw 53 is tightened, and hinges 55*a* and 55*b* are unlocked. This enables the user to push handles 52*a* and 52*b* in a to-and-fro second arm movement exercise about the rigid arm support post 50. Optimally resistive springs 57(*a*) and 57(*b*) can be provided to resist this second arm movement, as shown in FIG. 5. The springs 57(*a*) and 57(*b*) preferably extend between respective handles 52(*a*) and 52(*b*) and the arm support post 50**.

When not utilized by the user, the handles **52*a* and 52*b* can be folded down along side arm post 50, so as to snap into a position alongside the arm post 50. This enables the user to operate the third arm exerciser 60 free from any interference. This folding action is shown in FIG. 4**.

Attached to the arm post 50 is a hand-rotatable torque resisting device 60, as best seen in FIG. 1. By adjusting the arm support post 50, the device 60 can be placed at approximately the elbow height of the user to provide a comfortably positioned third arm-exercise movement. The rotatable torque-resisting device 60, as shown in FIG. 1, includes two wheels or sprockets 68 and 70. Screw 66 provides a torque-resisting means to impede or ease the circular motion of wheel or sprocket 70. Via a chain or torque transmission belt 64, the spring-adjusted ease or difficulty of rotating the wheel or sprocket 70 is transferred to the wheel or sprocket 68, thereby increasing or decreasing the required force to rotate it. Handles **62*a* and 62*b*, which are attached to the wheel or sprocket 68, are grasped by the user and rotated in a circular motion, thereby rotating the wheel or sprocket 68. The above-described torque resistive means 60** allows for a third arm-movement exercise which develops muscle tone in the user's arms, hands, shoulders, and chest.

Because the arm support post 50 optimally rotates a piston in unison with user support 16, the user can tone his or her upper body, utilizing his or her choice of the three arm-movement exercise means, while simultaneously jogging in place. When the user support 16 is in an inclined position, the user benefits from exercising his upper body, as well as his lower body free from any of the associated risks of jogging in an upright position.

A timer 72 is provided to record the exercise time of the user. This timer is also equipped with an alarm to inform the user that a preset length of exercise time has expired.

The present invention provides a user with the opportunity to exercise his or her upper and lower body simultaneously, and at a number of selectable positions, ranging from vertical to inclined positions. This position-adjustment feature allows individuals with foot and leg impairments to remain physically fit inspite of any potentially decapacitating ailments.

I wish it be understood that I do not desire to limit myself to the exact details of construction as shown and described, for obvious modifications will occur to persons skilled in the art.

I claim:

1. An exercise machine, comprising in combination a base, exercise means mounted on said base for exercising at least the limbs of a user, positionally adjustable user support means pivotally connected to said base for permitting the user to actuate said exercise means in a selected posture between upright and inclined positions, and adjustment means for adjusting said user support means in discrete steps to a selected position within the range of said upright and inclined positions, wherein said base is a stand, and wherein said user support means includes an L-shaped bracket having two arms, one relatively short arm and one relatively long arm, a shorter arm thereof being pivotally connected to said stand, wherein an upwardly pointing surface of said stand is formed with a plurality of ratchet-like teeth normally pointing upwardly, and wherein said adjustment means includes a pawl pivotally connected to a longer arm of said L-shaped bracket, and engageable with a free end thereof with one of said ratchet-like teeth on said stand.

2. The exercise machine as claimed in claim 1, further comprising timing means for timing the user's elapsed exercise time, and including alarm means for notifying the user that a preset exercise time has elapsed.

3. An exercise machine, comprising in combination a base, exercise means mounted on said base for exercising at least the limbs of a user, positionally adjustable user support means connected to said base for permitting the user to actuate said exercise means in a selected posture between upright and inclined positions, foot exercise means in the form of two foot rests mounted on said base, said foot rests being movable from respective rest positions, and first urging means said foot rests to remain in said rest positions, and wherein said first urging means comprise two cylinder-piston units, each piston being connected to respective foot rest, and a spring interposed between each cylinder and piston urging the piston to remain in a respective rest position.

4. The exercise machine as claimed in claim 3, wherein each foot rest includes attachment means for the feet of the user to at least slip thereinto.

5. The exercise machine as claimed in claim 3, further comprising a pedometer operatively connected to at least one of said foot rests for measuring the number of exercise steps completed by the user.

6. An exercise machine, comprising in combination a base, exercise means mounted on said base for exercising at least the limbs of a user, positionally adjustable user support means connected to said base for permitting the user to actuate said exercise means in a selected posture between upright and incline positions, wherein said exercise means comprises arm exercise means including an arm support post pivotally mounted on said base and extending outwardly therefrom, two longitudinal members mounted near a free end of said arm support post, and normally extending perpendicularly therefrom, and second urging means for urging said arm support post to remain in a rest position, whereby a user may reciprocally move said arm post in a vertical plane against theresistance of said second urging means, and wherein said arm exercise means includes rotatable torque resisting means mounted on said arm support post, and two handles extending from said torque resisting means.

7. The exercise machine as claimed in claim 6, further comprising torque adjustment means for adjusting the torque offered to the user by said torque resisting means.

8. The exercise machine as claimed in claim 6, further comprising third urging means for urging said longitudinal members to normally occupy a position in which they extend in line with one another, so as to permit the user to perform a rowing movement against resistance.

* * * * *